US007247988B2

(12) United States Patent
Lee et al.

(10) Patent No.: US 7,247,988 B2
(45) Date of Patent: Jul. 24, 2007

(54) PLASMA DISPLAY PANEL

(75) Inventors: Gi Bum Lee, Changwon-si (KR); Jin Young Kim, Daegu (KR)

(73) Assignee: LG Electronics Inc., Seoul (KR)

( * ) Notice: Subject to any disclaimer, the term of this patent is extended or adjusted under 35 U.S.C. 154(b) by 164 days.

(21) Appl. No.: 11/022,940

(22) Filed: Dec. 28, 2004

(65) Prior Publication Data

US 2005/0162083 A1 Jul. 28, 2005

(30) Foreign Application Priority Data

Dec. 31, 2003 (KR) ..... 10-2003-0102178

(51) Int. Cl.
*H01J 17/49* (2006.01)

(52) U.S. Cl. ..... 313/582; 313/581

(58) Field of Classification Search ..... 313/581–587
See application file for complete search history.

(56) References Cited

U.S. PATENT DOCUMENTS 5,744,909 A * 4/1998 Amano ..... 313/585
6,515,419 B1 2/2003 Lee et al.
6,853,136 B2 * 2/2005 Kim et al. ..... 313/582
2006/0113913 A1 * 6/2006 Lee et al. ..... 313/585

FOREIGN PATENT DOCUMENTS

CN 1344003 A 4/2002
JP 2003-257326 9/2003
KR 10-2005-0011273 A 1/2005

* cited by examiner

*Primary Examiner*—Ashok Patel
(74) *Attorney, Agent, or Firm*—McKenna Long & Aldridge

(57) ABSTRACT

A plasma display panel for improving a color coordinates correction and a color temperature is disclosed. In the plasma display panel, a vertical barrier rib separates red, green and blue discharge cells from each other in a longitudinal direction. A horizontal barrier rib is provided between the vertical barrier ribs to separate the red, green and blue discharge cells from each other in a wide direction. The horizontal barrier rib has a first horizontal barrier rib provided between the red discharge cells, a second horizontal barrier rib provided between the green discharge cells, and a third horizontal barrier rib provided between the blue discharge cells and having a smaller width than the first and second horizontal barrier ribs.

3 Claims, 5 Drawing Sheets

W1 = W2 = W3

W1 < W2 < W3

W1 = W2 = W3

H1 > H2 > H3

PLASMA DISPLAY PANEL

This application claims the benefit of Korean Patent Application No. P2003-102178 filed in Korea on Dec. 31, 2003, which is hereby incorporated by reference.

BACKGROUND OF THE INVENTION

1. Field of the Invention

This invention relates to a plasma display panel, and more particularly to a plasma display panel that is adaptive for improving a color coordinates correction and a color temperature.

2. Description of the Related Art

Generally, a plasma display panel (PDP) radiates a phosphorous material using an ultraviolet ray with a wavelength of 147 nm generated upon discharge of an inactive mixture gas such as He+Xe, Ne+Xe or He+Ne+Xe, to thereby display a picture including characters and graphics. Such a PDP is easy to be made into a thin-film and large-dimension type. Moreover, the PDP provides a very improved picture quality owing to a recent technical development. Particularly, since a three-electrode, alternating current (AC) surface-discharge PDP has wall charges accumulated in the surface thereof upon discharge and protects electrodes from a sputtering generated by the discharge, it has advantages of a low-voltage driving and a long life.

Referring to FIG. 1, a discharge cell of the conventional three-electrode, AC surface-discharge PDP includes a scan electrode Y and a sustain electrode Z provided on an upper substrate 10, and an address electrode X provided on a lower substrate 18.

The scan electrode Y includes a first transparent electrode 12Y, and a first bus electrode 13Y provided at the rear side of the first transparent electrode 12Y. The sustain electrode Z includes a second transparent electrode 12Z, and a second bus electrode 13Z provided at the rear side of the second transparent electrode 12Z.

The first and second transparent electrodes 12Y and 12Z are usually made from a transparent material so as to transmit a light from the discharge cell. At the rear sides of the first and second transparent electrodes 12Y and 12Z, the first and second bus electrodes 13Y and 13Z made from a metal material are provided in parallel to the first and second transparent electrodes 12Y and 12Z. The first and second bus electrodes 13Y and 13Z are used for applying driving signals to the first and second transparent electrodes 12Y and 12Z having a high resistance value. On the upper substrate 10 provided with the first transparent electrode 12Y and the second transparent electrode 12Z in parallel to each other, an upper dielectric layer 14 and a protective film 16 are disposed. Wall charges generated upon plasma discharge are accumulated into the upper dielectric layer 14. The protective film 16 prevents a damage of the upper dielectric layer 14 caused by a sputtering during the plasma discharge and improves the emission efficiency of secondary electrons. This protective film 16 is usually made from magnesium oxide (MgO).

A lower dielectric layer 22 and barrier ribs 24 are formed on the lower substrate 18 provided with the address electrode X. The surfaces of the lower dielectric layer 22 and the barrier ribs 24 are coated with a phosphorous material layer 26. The address electrode X is formed in a direction crossing the first transparent electrode 12Y and the second transparent 12Z. The barrier rib 24 is provided in parallel to the address electrode X to thereby prevent an ultraviolet ray and a visible light generated by a discharge from being leaked to the adjacent cells.

The phosphorous material layer 26 is excited by an ultraviolet ray generated during the plasma discharge to generate any one of red, green and blue visible light rays. An inactive mixture gas, such as He+Xe, Ne+Xe or He+Ne+Xe, for providing a gas discharge is injected into a discharge space defined between the upper and lower substrate 10 and 18 and the barrier rib 24.

In Such a PDP, the discharge cells sustain a discharge by the surface discharge between the scan electrode Y and the sustain electrode Z after they were selected by the opposite discharge between the scan electrode Y and the sustain electrode Z. The discharge cell of the PDP radiates the phosphorous material 26 by an ultraviolet ray generated upon the sustain discharge, thereby emitting a visible light into the exterior thereof. As a result, the PDP having the discharge cells displays a picture.

In such a conventional PDP, the phosphorous material 26 is excited by a vacuum ultraviolet ray Δ UV with a short wavelength produced upon discharge to generate a unique color visible light ray, thereby displaying red, green and blue colors R, G and B that are three initial colors of a light at each discharge cell. In the PDP, a color coordinates of a full white is greatly influenced by a substance of the phosphorous material 26 and a used inactive gas. For this reason, the phosphorous material 26 requires a coating over a wider area besides an improvement of its substance property and a uniform coating characteristic at the inner wall of the barrier rib.

To this end, the barrier rib coated with the phosphorous material 26 needs to have a structurally wide area. In other words, a stripe-type barrier rib 24 as shown in FIG. 2 has an advantage in that it does not have any structure for making a shut-off between the barrier ribs 24 to form a flowing path of an air, thereby making an air exhaust and a gas injection easily when an exhaust process of making the discharge space into a vacuum state for the sake of an injection of the mixture gas is performed. On the other hand, the PDP adopting the stripe-type barrier rib 24 has disadvantages in that it fails to have a high brightness characteristic because an amount of the visible light amount produced by a radiation of the phosphorous material 26 within the discharge cell is small due to a limitation in its area coated with the phosphorous material and in that a width of the gas flowing path between the upper and lower discharge cells is large due to a non-existence of the structure provided between the barrier ribs 24 at a region where the upper and lower discharge cells are divided, thereby causing a cross talk to lead to a color interference phenomenon between the pixels of the PDP.

In such a conventional PDP having such a stripe-type barrier rib 24, in order to achieve a color temperature improvement and a color coordinates correction, a structure of the stripe-type barrier rib 24 is provided in a non-symmetric shape to change a mutual area ratio among the discharge cell for implementing a red color R, the discharge cell for implementing a green color G and, the discharge cell for implementing a blue color B, thereby compensating a color coordinates based on a change in the light-emission area. In this case, the discharge cell for implementing the red color R has a higher light-emission brightness than the discharge cells for implementing the green color G and the blue color B, whereas the discharge cell for implementing the green color G has a higher light-emission brightness than the discharge cell for implementing the blue color B.

Accordingly, a distance (i.e., pitch) between the barrier ribs 28 for separating the red(R), green(G) and blue(B) discharge cells from each other is formed in a non-symmetric type to make a relationship of the blue(B)>the green(G) >the red(R), thereby adjusting a color coordinates of the full white. Therefore, a pitch of the discharge cell for implementing the blue color B has the largest size, and a pitch of the discharge cell for implementing the green color G has a smaller size than the blue(B) discharge cell and a larger size than the red(R) discharge cell. Thus, a pitch of the blue(B) discharge cell is increased to have a larger light-emission area than the symmetrical structure, thereby providing a color coordinates correction and a color temperature improvement.

However, the PDP in which a pitch between the discharge cells for implementing the red(R), green(G) and blue(B) colors has a non-symmetric structure has a problem in that horizontal pitches of the red(R), green(G) and blue(B) discharge cells are too reduced as a resolution of the PDP goes higher, thereby causing an increase of discharge voltage, a reduction of operation margin and a reduction of brightness/efficiency characteristics.

SUMMARY OF THE INVENTION

Accordingly, it is an object of the present invention to provide a plasma display panel that is adaptive for improving a color coordinates correction and a color temperature.

In order to achieve these and other objects of the invention, a plasma display panel according to one embodiment of the present invention includes a vertical barrier rib for separating red, green and blue discharge cells from each other in a longitudinal direction; and a horizontal barrier rib, being provided between the vertical barrier ribs, for separating the red, green and blue discharge cells from each other in a wide direction, wherein said horizontal barrier rib has a first horizontal barrier rib provided between the red discharge cells; a second horizontal barrier rib provided between the green discharge cells; and a third horizontal barrier rib provided between the blue discharge cells and having a smaller width than the first and second horizontal barrier ribs.

In the plasma display panel, the first horizontal barrier rib has a larger width than the second horizontal barrier rib.

The vertical barrier rib is provided such that horizontal pitches of the red, green and blue discharge cells are equal to each other.

Herein, the vertical barrier ribs have the same width.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Hereinafter, the preferred embodiments of the present invention will be described in detail with reference to FIGS. 4 and 5.

Figure 1:
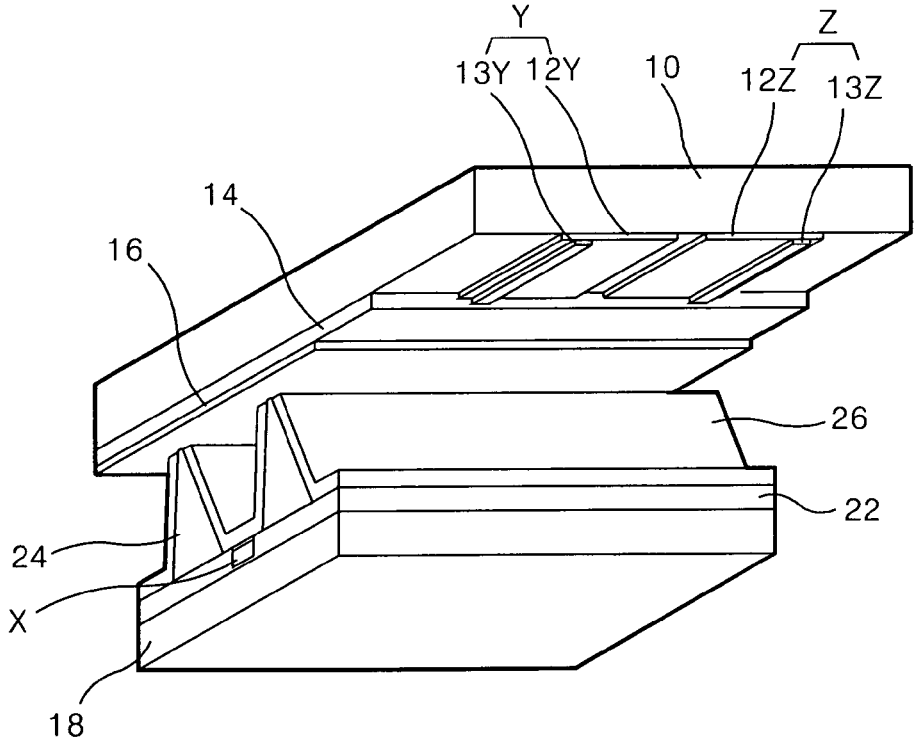
FIG. 1 RELATED ART
FIG. 1 is a perspective view showing a discharge cell structure of a conventional plasma display panel.
Figure 2:
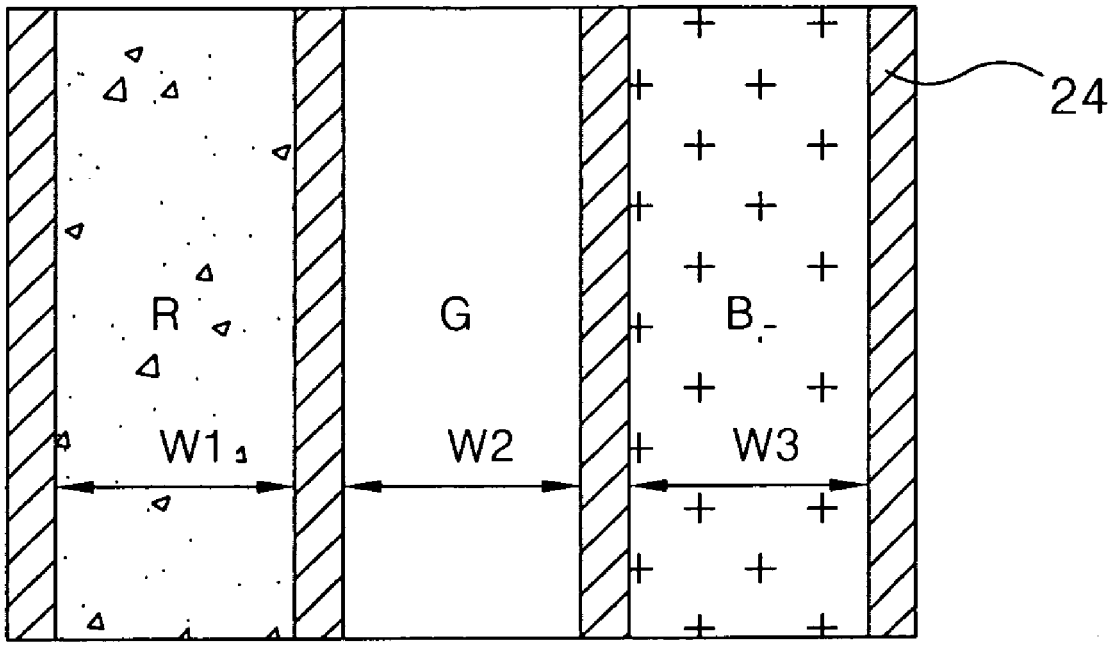
FIG. 2 RELATED ART
FIG. 2 is a plan view showing a discharge cell having a symmetrical structure shown in FIG. 1.
Figure 3:
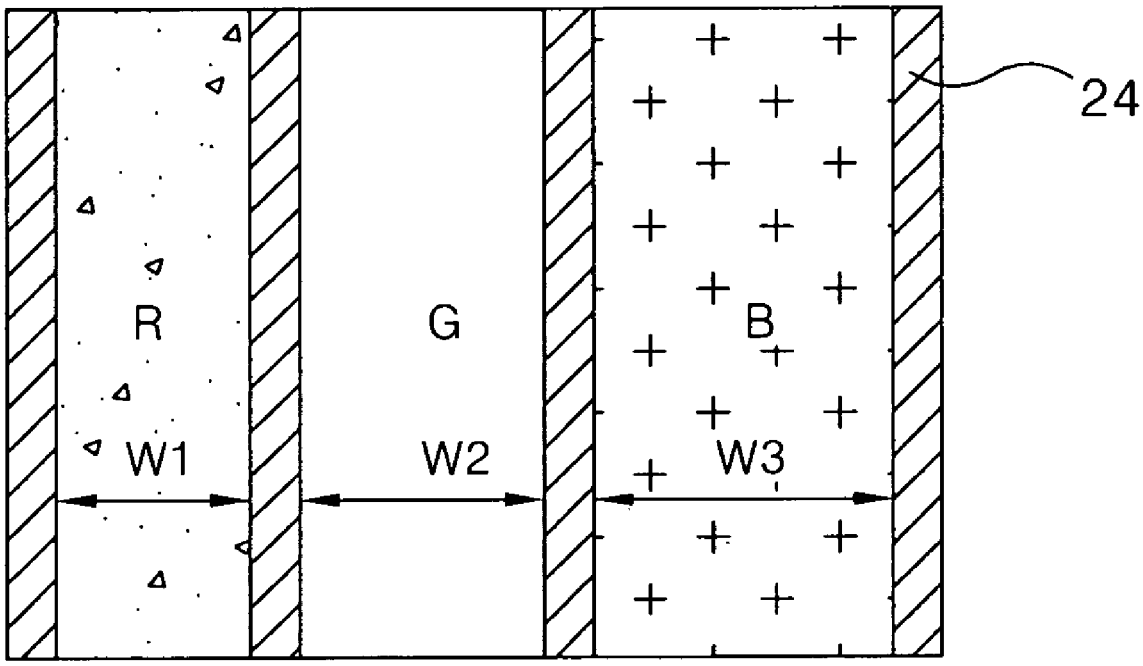
FIG. 3 RELATED ART
FIG. 3 is a plan view showing a discharge cell having a non-symmetrical structure shown in FIG. 1.
Figure 4:
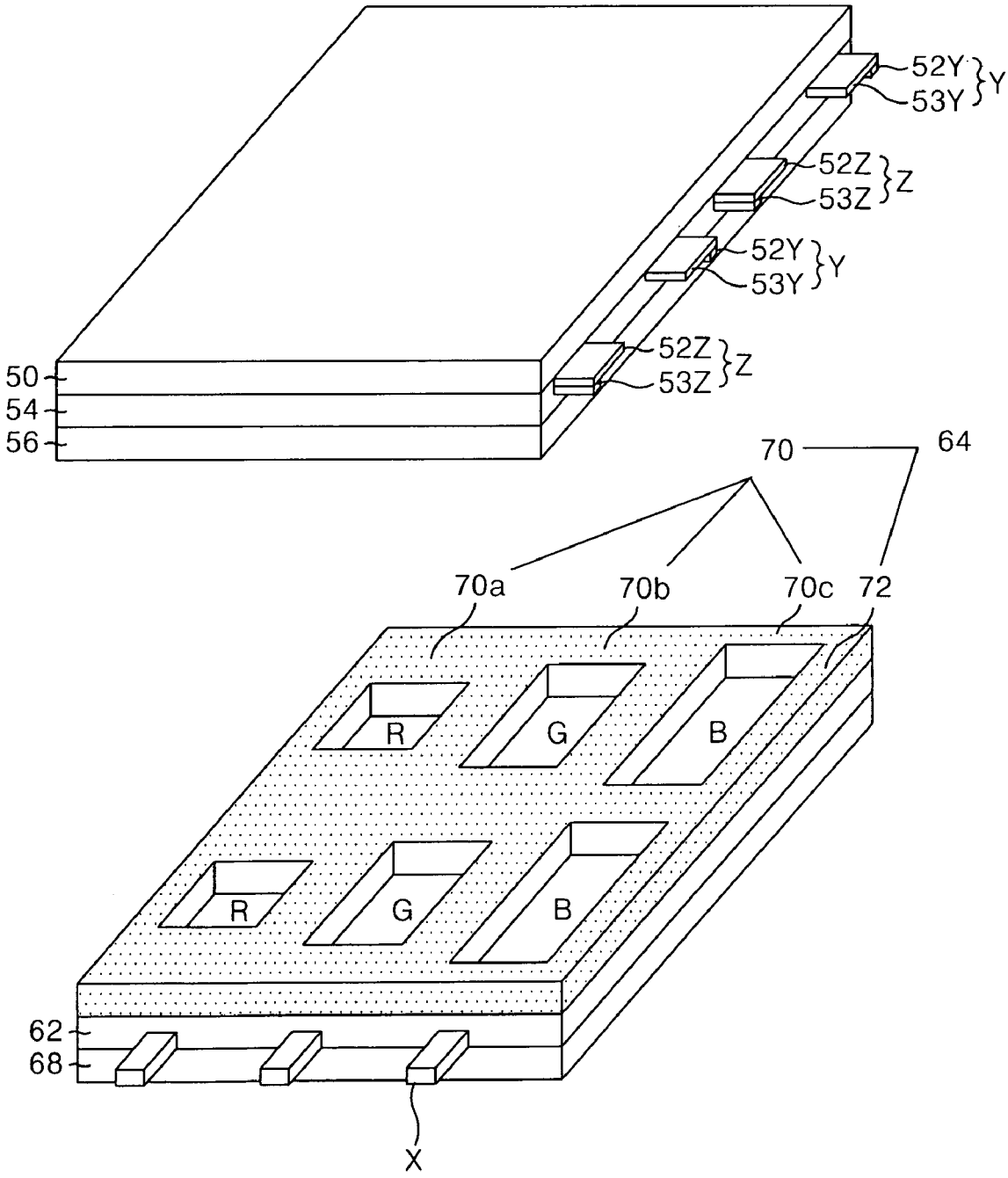
FIG. 4 is a perspective view showing a structure of a plasma display panel according to an embodiment of the present invention.
Figure 5:
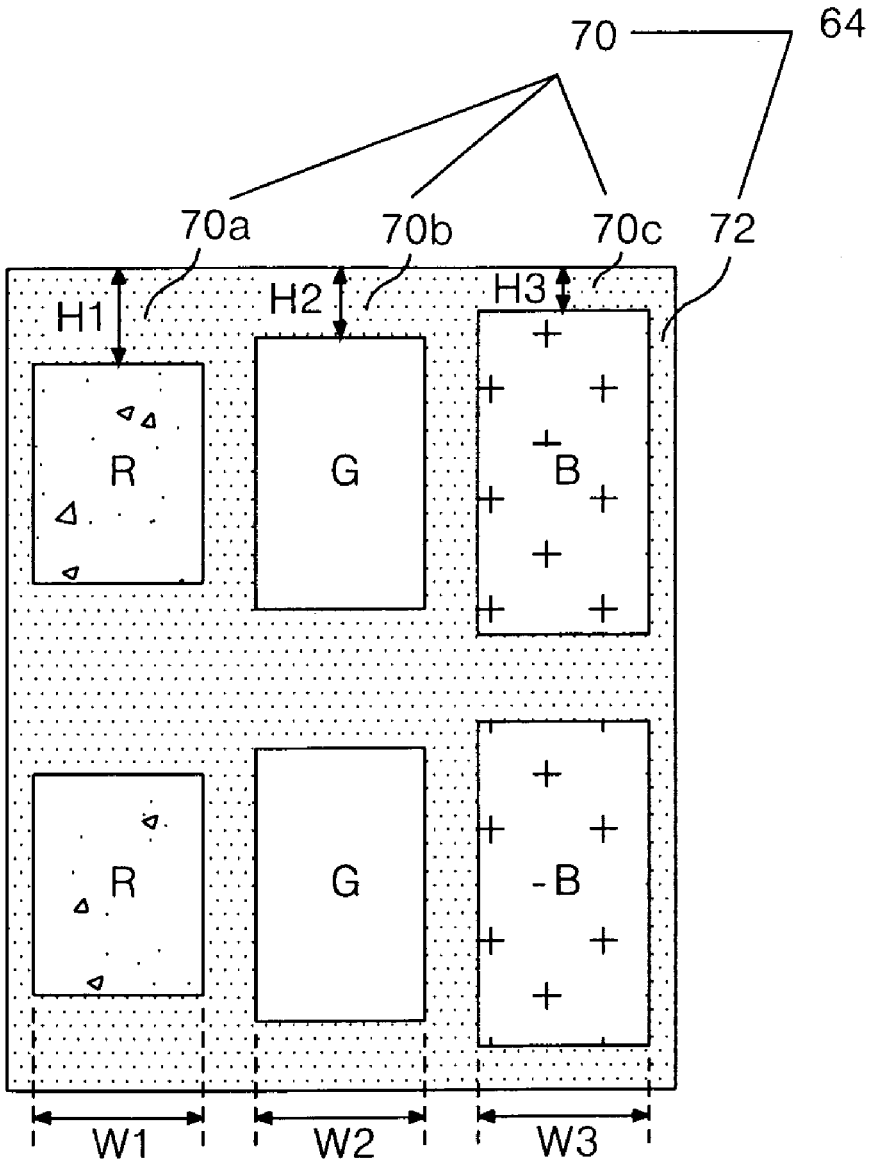
FIG. 5 is a plan view of the plasma display panel shown in FIG. 4.

FIG. 4 is a perspective view showing a structure of a plasma display panel according to an embodiment of the present invention, and FIG. 5 is a plan view of a lower substrate in the plasma display panel shown in FIG. 4.

Referring to FIG. 4 and FIG. 5, a discharge cell of the PDP according to the embodiment of the present invention includes a scan electrode Y and a sustain electrode Z provided on an upper substrate 50, and an address electrode X provided on a lower substrate 68.

The scan electrode Y includes a first transparent electrode 52Y, and a first bus electrode 53Y provided at the rear side of the first transparent electrode 12Y. The sustain electrode Z includes a second transparent electrode 52Z, and a second bus electrode 53Z provided at the rear side of the second transparent electrode 52Z.

The first and second transparent electrodes 52Y and 52Z are usually made from a transparent material so as to transmit a light from the discharge cell. At the rear sides of the first and second transparent electrodes 52Y and 52Z, the first and second bus electrodes 53Y and 53Z made from a metal material are provided in parallel to the first and second transparent electrodes 52Y and 52Z. The first and second bus electrodes 53Y and 53Z are used for applying driving signals to the first and second transparent electrodes 52Y and 52Z having a high resistance value. On the upper substrate 50 provided with the first transparent electrode 52Y and the second transparent electrode 52Z in parallel to each other, an upper dielectric layer 54 and a protective film 56 are disposed. Wall charges generated upon plasma discharge are accumulated into the upper dielectric layer 54. The protective film 56 prevents a damage of the upper dielectric layer 54 caused by a sputtering during the plasma discharge and improves the emission efficiency of secondary electrons. This protective film 56 is usually made from magnesium oxide (MgO).

A lower dielectric layer 62 and barrier ribs 64 are formed on the lower substrate 68 provided with the address electrode X. The surfaces of the lower dielectric layer 62 and the barrier ribs 64 are coated with a phosphorous material (not shown). The address electrode X is formed in a direction crossing the first transparent electrode 52Y and the second transparent 52Z.

The barrier rib 64 is provided in parallel to the address electrode X to prevent an ultraviolet ray generated by a discharge from being leaked to the adjacent cells, thereby preventing an electrical and optical cross talk between the adjacent discharge cells. To this end, the barrier rib 64 includes a vertical barrier rib 72 provided in parallel to the address electrode X, and a horizontal barrier rib 70 provided between the adjacent vertical barrier ribs 72.

The vertical barrier ribs 72 are formed at the same width and the same distance to equalize horizontal pitches W1, W2 and W3 of red(R), green(G) and blue(B) discharge cells.

The horizontal barrier rib 70 is provided between the vertical barrier ribs 72 such that the red(R), green(G) and blue(B) discharge cells have a different width from each other. The horizontal barrier rib 70 includes a first horizontal barrier rib 70*a* provided between the red discharge cells and having a first width, a second horizontal barrier rib 70*b* provided between the green discharge cells and having a second width, and a third horizontal barrier rib 70*c* provided with the blue discharge cells and having a third width. Thus, the blue discharge cell B has the largest light-emission area; the green discharge cell G has the next light-emission area; and the red discharge cell R has the smallest light-emission area. Accordingly, the blue discharge cell B has the largest coated area of the phosphorous material as well as the widest discharge space, thereby increasing a light-emission brightness of the blue discharge cell B. As a result, a light-emission brightness of the discharge cell for implementing the red color R is higher than that of the discharge cells for implementing the green color G and the blue color B while a light-emission brightness of the discharge cell for implementing the green color G is higher than that of the discharge cell for implementing the blue color B, so that the entire light-emission brightness becomes uniform.

The phosphorous material is coated onto the surfaces of the lower dielectric layer 62 and the barrier rib 64 to generate any one of red, green and blue visible light rays. An inactive mixture gas, such as He+Xe, Ne+Xe or He+Ne+Xe, for providing a gas discharge is injected into a discharge space defined between the upper and lower substrate 50 and 58 and the barrier rib 64.

In such a PDP, the discharge cells sustain a discharge by the surface discharge between the scan electrode Y and the sustain electrode Z after they were selected by the opposite discharge between the scan electrode Y and the sustain electrode Z. The discharge cell of the PDP radiates the phosphorous material by an ultraviolet ray generated upon the sustain discharge, thereby emitting a visible light into the exterior thereof. As a result, the PDP having the discharge cells displays a picture.

Such a phosphorous material in the PDP according to the embodiment of the present invention is excited by a vacuum ultraviolet ray with a short wavelength produced upon discharge to generate a unique color visible light ray, thereby displaying red, green and blue colors R, G and B that are three initial colors of a light at each discharge cell. In this case, since the vacuum ultraviolet ray is mainly generated at the center portion of the discharge cell, it is more increased as it becomes closer to the center portion of the discharge cell, thereby raising a conversion efficiency of the visible light.

Accordingly, in the PDP according to the embodiment of the present invention, widths of horizontal barrier ribs 124 adjacent to the red(R), green(G) and blue(B) discharge cells are differentiated to differently define the discharge spaces of the red(R), green(G) and blue(B) discharge cells, thereby improving a color temperature as well as correcting a color coordinates. In other words, the discharge space of the green(G) discharge cell can be enlarged to more improve a light-emission brightness of the green(G) discharge cell in comparison to the prior art. Moreover, the discharge space of the blue(B) discharge cell is larger than that of other discharge cells, so that it becomes possible to more improve a light-emission brightness of the blue(B) discharge cell in comparison to the prior art. As a result, the PDP according to the embodiment of the present invention can improve a color temperature and correct a color coordinates while making no effect to a driving voltage and brightness/efficiency characteristics at a high-definition panel.

As described above, the plasma display panel according to the present invention includes a different width of barrier ribs for each red, green and blue discharge cell. Accordingly, it becomes possible to improve a color temperature as well as to correct a color coordinates while making no affect to a driving voltage and brightness/efficiency characteristics at a high-definition panel.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel, comprising:

a vertical barrier rib for separating red, green and blue discharge cells from each other in a longitudinal direction; and a horizontal barrier rib, being provided between the vertical barrier ribs, for separating the red, green and blue discharge cells from each other in a wide direction, wherein said horizontal barrier rib includes:

a first horizontal barrier rib provided between the red discharge cells;

a second horizontal barrier rib provided between the green discharge cells; and a third horizontal barrier rib provided between the blue discharge cells and having a smaller width than the first and second horizontal barrier ribs and wherein the first horizontal barrier rib has a larger width than the second horizontal barrier rib.

2. The plasma display panel as claimed in claim 1, wherein the vertical barrier rib is provided such that horizontal pitches of the red, green and blue discharge cells are equal to each other.

3. The plasma display panel as claimed in claim 2, wherein the vertical barrier ribs have the same width.

* * * * *